United States Patent [19]

Schwuchow

[11] Patent Number: 4,650,987

[45] Date of Patent: Mar. 17, 1987

[54] CHEST FOR THE STORAGE OF LIGHT SENSITIVE FILM MATERIAL OR PAPER

[76] Inventor: Klaus P. R. Schwuchow, Walter Kollo Str. 39, 6232 Bad Soden/Ts., Fed. Rep. of Germany

[21] Appl. No.: 738,425

[22] Filed: May 28, 1985

[51] Int. Cl.[4] ..... H01J 40/14

[52] U.S. Cl. ..... 250/215; 70/DIG. 51; 354/354; 355/72

[58] Field of Search ..... 250/215; 70/63, 69, 70/77, 78, 158, 159, DIG. 51; 354/76, 281, 297, 307, 354; 355/72; 206/578

[56] References Cited

U.S. PATENT DOCUMENTS 3,198,883 8/1965 Borberg et al. ..... 250/215

*Primary Examiner*—Edward P. Westin

*Attorney, Agent, or Firm*—Robert J. Koch

[57] ABSTRACT

An apparatus for the prevention of the unintentional exposure of photo material includes an electromagnetically locking flap on an apparatus designed as a storage chest for photo material. The flap as a cover for said chest and a photocell or the like respond to the luminosity of the environment. In the case of the prevalence of an adequate darkness a solenoid affects the magnet so as to unlock the cover.

6 Claims, 1 Drawing Figure

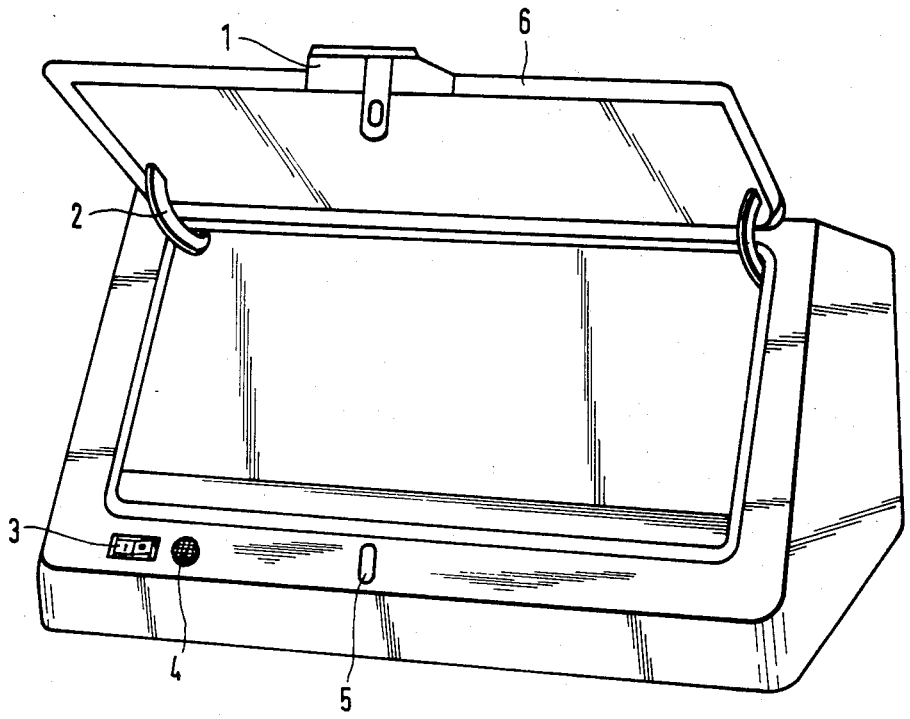
1
6
2
3
4
5

CHEST FOR THE STORAGE OF LIGHT SENSITIVE FILM MATERIAL OR PAPER

BACKGROUND OF THE INVENTION

1. Field of the Invention

The invention concerns a chest for the storage of light sensitive film material or paper, which may be opened only under dark room light. The invention is to prevent the unintentional opening of the film chest in the dark room under a bright or normal light and thus the preexposure of the film or paper material.

2. Background of the Art

Film chests or cabinets are not secured and therefore may be opened even under a bright light. It is known to place these film chests or cabinets in dark rooms. The security of the entry door of the dark room is often insufficient as the film chests and cabinets may be opened under bright lights. Thus valuable film material is frequently preexposed and destroyed. A known apparatus to prevent the unintentional exposure of photo material involves a light trap in the form of a service hatch to be set into a wall opening. Even though two interlocking covers are present, their true function, i.e. to prevent unintentional exposure, may be overlooked.

SUMMARY OF THE INVENTION

This problem is overcome by the chest of the instant invention wherein a photosensitive cell is built into the chest or cabinet and adjusted so that the locking of the chest or cabinet is effected by means of a solenoid. The solenoid permits the chest or cabinet to be opened only if the prevailing light is less than the preset luminous intensity (lux).

In a further development of the invention, the chest is equipped with an opening flap which is fastened by means of special hinges to the upper edge of the chest and may be opened only far enough so that it will close by its own weight after opening.

Light sensitive film material such as photographic film and x-ray film may be stored safely in the chest or cabinet of the invention without an unintentional opening of the chest or cabinet. Unintentional preexposure of the material is therefore prevented.

BRIEF DESCRIPTION OF THE DRAWING OF THE INVENTION

An advantageous embodiment of the invention is described with reference to the drawing. The apparatus illustrated comprises a chest into which for example unexposed x-ray films may be placed in an arrangement according to size.

DETAILED DESCRIPTION OF THE DRAWING

Careless opening of the cover 6 that may be flipped upwards by means of the hinge 2, would render the stock of valuable x-ray films useless. The cover is therefore equipped with a locking projection 1 which in the closed state of the cover may be locked by means of the solenoid 5 located in the housing to block the cover. Only in the case of an adequately low environmental luminosity does the photocell 4 built into the housing provide an electric current weak enough so that it leads by means of an appropriate electric circuit to an actuation of the magnet and the unlocking of the cover. The symbol 3 designates a switch to affect the functioning of the magnets below a certain luminosity through electronic means, i.e. the magnet responds to the pressure of the switch and opens the lock. In case of a luminosity higher than desired, the solenoid remains without current and the lock is not eliminated by pressing the switch.

The hinge 2 of the chest like apparatus has the characteristic that it may be raised only to the extent whereby it drops back into its closed state automatically when released. The layout is further such that the solenoid locks the cover normally and until actuated by a low light condition sensed in the photocell and transmitted electrically, so that the cover cannot be opened carelessly even in the case of a power failure.

I claim:

1. Apparatus for the light-safe storage of photosensitive materials comprising:

a light-safe storage chest;

an access door on said chest;

means for electronically locking said access door in a closed position; and means for unlocking said access door in predetermined low light conditions said means including a photocell mounted on said chest and an electric circuit for transmitting the condition of said photocell to said electronic locking means.

2. The apparatus of claim 1 wherein said electronic locking means includes a magnetically operated lock and a solenoid.

3. The apparatus of claim 1 wherein said access door is mounted on said storage chest such that it closes by means of its own weight.

4. The apparatus of claim 2 wherein said solenoid is activated in a predetermined light condition by means of said electric circuit to unlock said access door.

5. The apparatus of claim 2 wherein said electronic locking means locks said door whenever said solenoid is unactivated.

6. The apparatus of claim 2 wherein said solenoid is unactivated above a predetermined low light condition and during power failure.

* * * * *